US007830749B2

(12) United States Patent
Kyllingstad

(10) Patent No.: US 7,830,749 B2
(45) Date of Patent: Nov. 9, 2010

(54) METHOD OF FILTERING PUMP NOISE

(75) Inventor: Åge Kyllingstad, Ålgård (NO)

(73) Assignee: National Oilwell Norway AS (NO)

( * ) Notice: Subject to any disclaimer, the term of this patent is extended or adjusted under 35 U.S.C. 154(b) by 775 days.

(21) Appl. No.: 11/628,563

(22) PCT Filed: Jun. 20, 2005

(86) PCT No.: PCT/NO2005/000217

§ 371 (c)(1),
(2), (4) Date: Jul. 25, 2007

(87) PCT Pub. No.: WO2006/001704

PCT Pub. Date: Jan. 5, 2006

(65) Prior Publication Data

US 2008/0259728 A1 Oct. 23, 2008

(30) Foreign Application Priority Data

Jun. 24, 2004 (NO) ..... 20042651

(51) Int. Cl.
*E21B 47/18* (2006.01)

(52) U.S. Cl. ..... 367/83; 175/45

(58) Field of Classification Search ..... 367/81–83; 175/45

See application file for complete search history.

(56) References Cited

U.S. PATENT DOCUMENTS

| | | | | |
|---|---|---|---|---|
| 3,964,556 | A * | 6/1976 | Gearhart et al. | 175/45 |
| 4,224,687 | A | 9/1980 | Claycomb | |
| 4,642,800 | A * | 2/1987 | Umeda | 367/85 |
| 4,878,206 | A * | 10/1989 | Grosso et al. | 367/83 |
| 5,146,433 | A | 9/1992 | Kosmala et al. | |
| 6,741,185 | B2 * | 5/2004 | Shi et al. | 340/853.2 |
| 7,130,751 | B2 * | 10/2006 | Kyllingstad | 702/77 |
| 7,423,550 | B2 * | 9/2008 | Reckmann et al. | 340/855.7 |
| 2006/0132327 | A1 * | 6/2006 | Reckmann et al. | 340/855.4 |

FOREIGN PATENT DOCUMENTS

| | | |
|---|---|---|
| EP | 0 078 907 A2 | 5/1983 |
| EP | 0 535 729 A2 | 4/1993 |
| GB | 2 392 762 A1 | 3/2004 |

OTHER PUBLICATIONS

International Search Report for parent application PCT/NO2005/000217, having a mailing date of Oct. 4, 2005.

* cited by examiner

*Primary Examiner*—Ian J Lobo
(74) *Attorney, Agent, or Firm*—Conley Rose, P.C.

(57) ABSTRACT

A method of filtering out pressure noise generated by one or more piston pumps, where each pump is connected to a common downstream piping system, and where the discharge pressure is measured by a pressure sensitive gauge, wherein the instantaneous angular position(s) of the pump(s)' crankshaft or actuating cam is/are measured simultaneously with the discharge pressure and used as fundamental variables in an adaptive mathematical noise model.

5 Claims, 3 Drawing Sheets

METHOD OF FILTERING PUMP NOISE

CROSS-REFERENCE TO RELATED APPLICATIONS

This application is the U.S. national stage application of International Application PCT/NO2005/000217, filed Jun. 20, 2005, which International Application was published on Jan. 5, 2006, as International Publication No. WO 2006/001704 Al in the English language. The International Application claims priority of Norwegian Patent Application 20042651, filed Jun. 24, 2004.

BACKGROUND OF THE INVENTION

This invention regards a method of filtering pump noise. More specifically, it regards a method of eliminating or reducing pump generated noise in a telemetry signal transmitted via the fluid exiting from the pump, by using the instantaneously measured angular position of the pump as a fundamental variable in an adaptive mathematical noise model.

In this context, pump generated noise, pump noise or pressure noise mean measurement or test signals that can be attributed to the pressure fluctuations in the pumped fluid. The angular position of the pump means the angular position of the pump crankshaft or actuating cam axle.

Drilling fluid pulse telemetry is still the most commonly used method of transmitting downhole information to the is surface when drilling in the ground. A downhole telemetry unit, which is normally located in a drill string near the drill bit, measures parameters near the drill bit and encodes the information into positive and negative pressure pulses. These pressure pulses propagate through the drilling fluid in the drill string and on to the surface, where they are picked up by one or more pressure sensors and decoded.

Generally the pressure pulses will attenuate on their way up through the drill string, and the attenuation increases with frequency and transmission distance. In long wells therefore, the telemetry signal may become so weak as to make decoding difficult. Thus the pump generated pressure noise, which often contains components in the same frequency range as that of the telemetry signal, is a factor that limits the quality and rate of the data transmission. Thus reducing or eliminating pump noise is vital to allow the telemetry data rate to be increased.

Pump noise may be reduced mechanically by means of e.g. a pulsation moderator, or electronically by filtration of the measured pressure signal. The first method is not very suitable, as it also dampens the telemetry signal in addition to dampening the pump noise. Moreover, mechanical dampers represent undesirable costs.

Prior art comprises a variety of methods of filtering out pump noise. Many of these techniques describe methods which use more than one sensed pressure signal. It may for instance be a case of pressure signals sensed in several locations in the installation, or complementary flow rate measurements.

A characteristic of these known methods is the fact that the pump noise is related to time.

U.S. Pat. No. 5,146,433 describes a method in which the pump noise is related to the linear position of the pump piston. The piston position is measured by a so-called LVDT sensor. According to this method calibration must be carried out when there is no pulse telemetry signal present. These conditions represent significant disadvantages because the linear position of the piston does not fully define the angular position of the pump, and because many pulse telemetry systems can not be stopped after the drilling fluid rate has exceeded a certain level. Furthermore, the periods in which telemetry signals are transmitted may be of such a long duration that the drilling conditions and noise picture undergo significant changes. As an example, a valve may start to leak, whereby the noise picture will undergo a dramatic change, making the statically calibrated noise picture irrelevant.

SUMMARY OF THE INVENTION

The object of the invention is to remedy or reduce at least one of the disadvantages of prior art.

The object is achieved in accordance with the invention, by the characteristics given in the description below and in the following patent claims.

The method of the invention makes full use of the advantages of using the exact angular position of the pump measured synchronously with and related to the downstream pressure of the pump. The method can be applied both to one pump and to several synchronously and asynchronously driven pumps with a common outlet.

Separate and adaptive pump noise models are used for each pump, and the models are continuously updated while the pump is operating, regardless of whether there is a telemetry signal present or not.

Pressure noise from a pump mainly originates from flow fluctuations caused by:

1. Variable pump speed
2. Variable piston speed (in case of constant pump speed)
3. Valve delay
4. Cushioning effect of the valve seal
5. Fluid compressibility
6. Valve leaks
7. Piston leaks
8. Inertial effects from accelerations of valves and fluid columns.

Each of the causes is explained in a somewhat simplified manner below.

A variable pump speed may be caused by the speed control of the pump not being rigid enough to compensate for changing pump loads. The changes in pump load may be due to external pressure fluctuations owing to e.g. changes in torque in a downhole drilling fluid motor, or from self generated pressure fluctuations resulting from leaks or valve defects.

Variable piston speed means that the sum of the speed of all pistons in the pumping phase is not constant. A typical example is a common triplex pump, in which the crankshaft-driven pistons follow a distorted sinusoidal speed profile.

The mass inertia of the valve and a limited restoring spring force causes a delay in the closing of the valve and associated back flow.

The valve seal, which is often resilient, causes the valve to be displaced after reaching its valve seat without fluid passing the valve. This cushioning effect also gives rise to a small back flow until the valve attains metal-to-metal contact with the valve seat, whereby further displacement of the valve is prevented.

The compressibility of the fluid causes the fluid in the pump being compressed before reaching a pressure which is sufficient to open the outlet valve. The compression volume, which increases in proportion to the difference between the pump inlet and outlet pressures, represents a reduction in the flow of fluid at the start of each pump stroke.

Leakages from pistons and valves causes a portion of the total fluid flow to flow back to the pump or pump feed line. A valve defect in an outlet valve causes a reduction in pumping rate relative to the normal pumping rate during the suction stroke, while a leak in the piston or the inlet valve causes a reduction in the pumping rate during the pumping phase.

Upon closing of the valve, the inertia of the fluid will prevent an immediate cessation of flow and set up fluctuations like those known as pressure surges in hydraulic systems. Similarly the inertia of valves and fluid will cause a delay in the opening of valves, with associated fluctuations in the instantaneous flow of fluid. The amplitude of inertia induced flow and pressure fluctuations are small at low pump speeds but increase rapidly with increasing pump speed, being approximately proportionate to the square of the pump speed.

Many of the above sources can be easily simulated, in particular points 2-5. An example of this is shown in the specific part of the description.

For simplicity, the following is based on there being only one pump in operation. The model is later generalized to apply to several pumps.

If the pump rotates at constant speed it would be reasonable to assume that the contribution of the sources varies periodically with the inverse period of rotation as the fundamental frequency. Thus the flow rate of the pump can be represented by an angle based Fourier series $$q = \bar{q} + \sum_{k=1}^{\infty} q_k \cos(k\theta + \beta_k)$$

where $\theta$ is equal to the angular position of the pump in radians, $q_k$ is the average outflow rate of the pump, and $q_k$, $\beta_k$ are the amplitude and phase of flow rate harmonic component number k. The rotational speed of the pump is the time derivative of the angle of rotation of the pump;

$$\omega = \frac{d\theta}{dt}$$

It is customary to assume that the rotational speed of the pump is constant, making $\theta=\omega t$, however this is not a requirement here. The method also applies when the rotational speed varies.

The angular position of the pump can be measured in several ways. A practical method suited to gear-driven pumps is to use a motor encoder with standard counter electronics combined with a proximity switch at the crankshaft, camshaft or a piston. The proximity switch is used as a reference when calibrating the absolute angular position. It is common to normalise the angle to values of between 0 and $2\pi$, with 0 representing the start of the pump stroke for piston number 1.

For simplicity and in order to simplify the mathematical presentation a complex notation is adopted for the following.

Thus the flow harmonic q, and the phase angle $\beta_k$ can be represented by a complex amplitude $Q_k$ by $$q_k \cos(k\theta+\beta_k)=Re\{Q_k e^{i(k\theta)}\}$$

where $i=\sqrt{-1}$ is the imaginary unit. Similar complex amplitudes can also be defined for pressure, and the following employs lower case characters for time-dependent real quantities and upper case characters for complex amplitudes.

Because pressure fluctuations are much easier to measure than flow variations, it is necessary to know how the pressure varies with variations in flow rate. In general, the pressure is a-non-linear function of the flow rate, but for small amplitudes ($|Q_k|<<\bar{q}$) the pressure fluctuations may be linearized.

That is to say each harmonic flow rate component has corresponding pressure component that can be written as $P_k=H_kQ_k$ where H, is a complex frequency-dependent transfer function for component number k. For instance, the transfer function for en ideal damper connected in series with an infinitely long drill string with a uniform internal cross section is given by $$H_k = \frac{\rho c}{A} \cdot \frac{1}{1 + i(k\bar{\omega}\tau)}$$

where $\rho$ is the density of the fluid, c is the acoustic velocity of the fluid, A is the internal cross sectional area of the drill pipe, $\bar{\omega}$ is the mean angular rotational frequency of the pump and $\tau$ is the time constant of the damper. Assuming that the gas in the damper behaves like an ideal gas, $\tau$ is given by $$\tau = \left(V\kappa + \frac{V_g p_g}{\bar{p}^2}\right)\frac{\rho c}{A}$$

where V is the sum of the fluid volume inside the pump and in the damper, $\kappa=1/(c^2\rho)$ is the compressibility of the fluid, $V_g$ is the gas volume of the damper (equal to 0 if there is no damper) at the filling pressure $p_g$. Finally, $\bar{p}$ is the average discharge pressure. All pressures are absolute.

A similar transfer function can be set up when the infinitely long pipe is replaced with a throttle. The formulae for $H_k$ and $\tau$ for this system are the same as those explained above, except for that $\rho c/A$ must be replaced by the ratio $\alpha\bar{p}/\bar{q}$, where $\alpha$ is the pressure drop exponent for the throttle, normally in the range 1.5 to 2.

For both geometries, the transfer function represents a first order so-called low pass filter that acts as an effective smoothing filter at relatively high frequencies. The time constant formulae are general and apply also when there is no specific damper present. This is because the volume in the pump between the suction valve and the discharge is large enough to act as a fluid damper.

For more complicated discharge pipe geometries that may include cross sectional changes or have a flexible hose section the transfer function $H_k$ becomes more complicated. Without going into detail, one assumes that the transfer function and its inverse level can be determined, theoretically or experimentally, with sufficient accuracy.

The total dynamic pressure from all periodic noise components from the pump can now be expressed by the following infinite series:

$$p = \bar{p} + \sum_{k=1}^{\infty} \mathrm{Re}\{P_k e^{i(k\theta)}\} = \bar{p} + \sum_{k=1}^{\infty} \mathrm{Re}\{H_k Q_k e^{i(k\theta)}\}.$$

In practice, the number of terms must be limited. The required number of terms is given by the ratio between the maximum frequency of the telemetry signal and the rotational frequency of the pump: $k_{max}=2\pi f_{max}/\bar{\omega}$. As an example; if the maximum frequency of the telemetry signal is 15 Hz and the pump rotates at 60 rpm ($\bar{\omega}=2\pi\cdot$rad/s), then $k_{max}=15$.

The above theory may be generalised so as also to apply to several pumps, by assuming that the noise components from the various pumps are independent of each other. This is a reasonable assumption, provided the common outlet pressure is treated as a constant parameter and not as a function of the total pumping rate.

BRIEF DESCRIPTION OF THE DRAWINGS

The following describes a non-limiting example of a preferred embodiment illustrated in the accompanying drawings, in which.

DETAILED DESCRIPTION OF THE DRAWINGS

Figure 1:
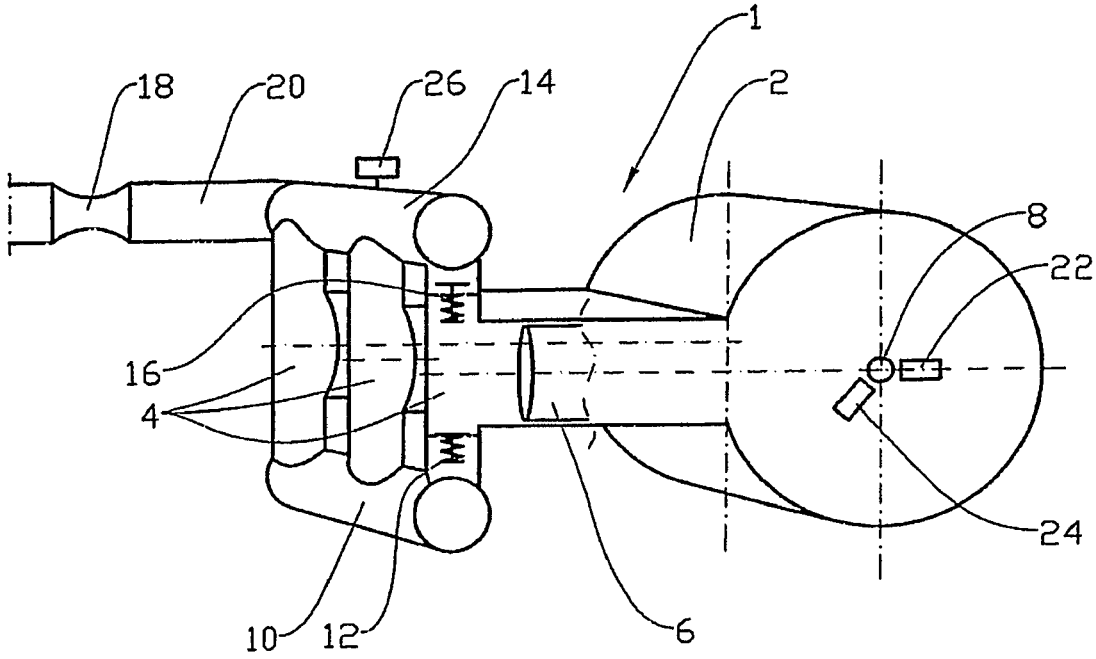
FIG. 1 is a schematic representation of a piston pump with three cylinders.

In the drawings, reference number 1 denotes a piston pump comprising a pump casing 2, three pistons 4, each with a separate piston 6, and a crankshaft 8. The piston 6 is connected to the crankshaft 8 by a piston rod (not shown).

The crankshaft 8 may also be comprised of a cam shaft. Each cylinder 4 communicates with a feed line 10 via an inlet valve 12 and with a discharge pipe 14 via a discharge valve 16. The discharge pipe 14 is connected to a throttle 18 via a pipe connection 20.

The piston pump 1 is furthermore provided with an angle transmitter 22 arranged to measure the rotational angle of the crankshaft 8. A proximity switch 24 is arranged to emit a signal when the crankshaft 8 is at a particular rotation angle, and a pressure gauge 26 is connected downstream of the pump 1. The respective transmitters 22, 24, 26 are connected to a signal processing system (not shown) via leads (not shown).

The piston pump 1 is of a type that is known per se. The piston 6 of the pump 1 in the example below has a length of stroke of 0.3048 m (12 in), the diameter of the piston 6 is 0.1524 m (6 in), the pump speed is 60 rpm, the discharge pressure is 300 bar, the compressibility of the fluid is $4.3 \times 10^{-10}$ l/Pa, the dead space (volume remaining between piston and associated valves at the end of the pump stroke) is 144% of the piston displacement, and the volume of the pipes 14, 20 before the throttle 18 is 0.146 $m^3$. No gas damper is installed.

In order to simplify the simulation below it is assumed that the valves 12 and 16 are ideal valves, i.e. without leakage or delays, and that the pump 1 rotates at a constant speed. Thus, only causes described under points 2 to 5 in the general part of the description are included.

Figure 2:
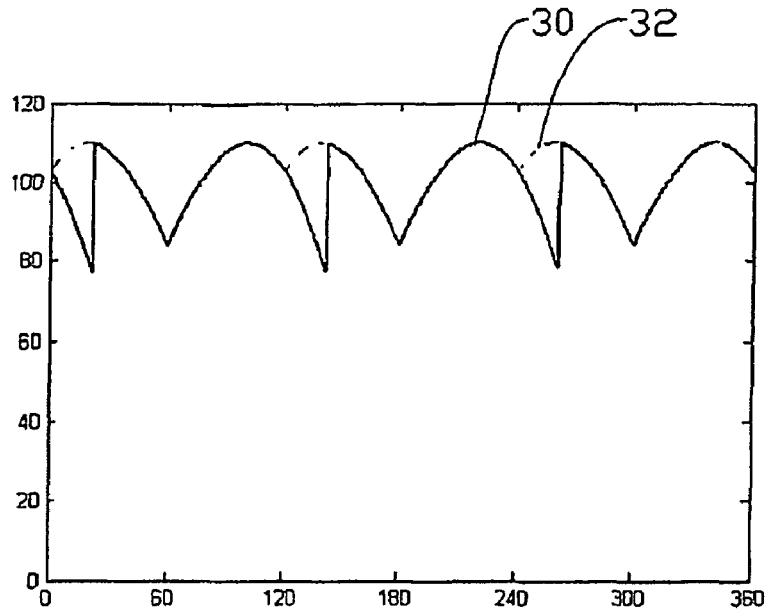
FIG. 2 shows the theoretical flow rate delivered from the pump as a percentage of the average flow rate versus the angular position of the crankshaft, in degrees.

The result of the simulation is shown in FIGS. 2 to 5. The solid curve 30 in FIG. 2 shows the theoretical flow rate from the pump 1 as a percentage of the average flow rate versus the angular position of the crankshaft 8, in degrees.

In order to illustrate the effect of fluid compression, FIG. 2 includes a dotted curve 32 representing the flow rate out of the pump 1 in the case of an incompressible fluid or with no pressure in the discharge pipe 14. The difference between the curves 30 and 32 shows a loss of flow during compression of the fluid (point 5). The variation in the curve 32 is due only to the variable speed of the pistons (point 2) and the sharp break points are change-overs where the number of pistons in the pumping phase changes from one to two or vice versa.

Figure 3:
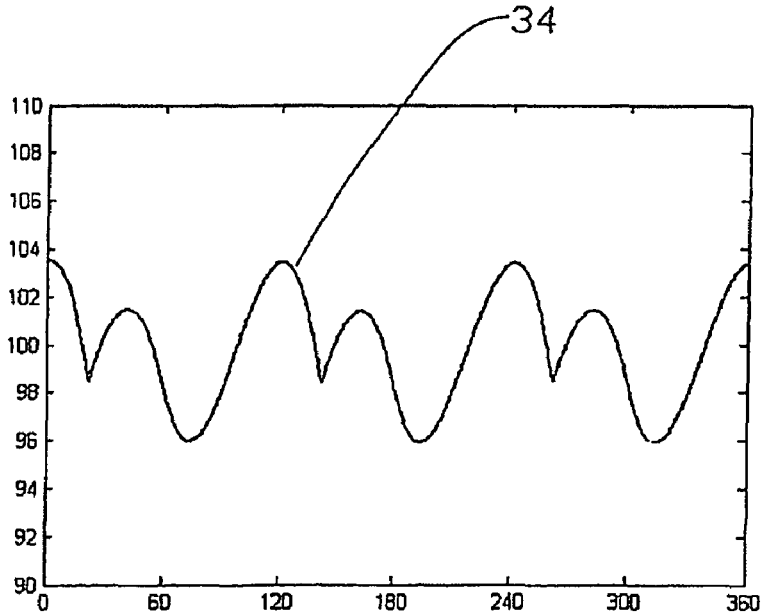
FIG. 3 shows the discharge pressure from the pump as a percentage of the average pressure versus the rotational angle of the crankshaft during one revolution.

In FIG. 3 the curve 34 shows the discharge pressure from the pump 1 as a percentage of the average pressure versus the rotational angle of the crankshaft 8 during one revolution. The curve 34 results when there is a set volume between the pump 1 and the throttle 18.

Figure 4:
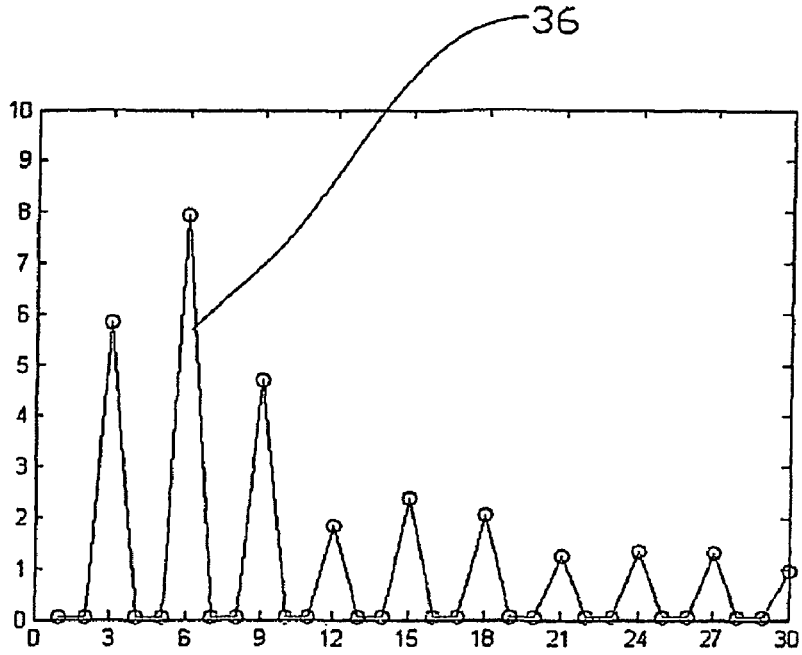
FIG. 4 shows the low frequency part of the amplitude spectrum of the normalized flow component versus the normalized pump frequency.

In FIG. 4 the curve 36 shows the low frequency part of the flow rate spectrum, i.e. normalized amplitude $|\hat{Q}_k|/\overline{q}$ as a function of the normalized frequency k. Because of symmetry, only components at harmonic frequencies are multiples of three times the fundamental frequency.

Figure 5:
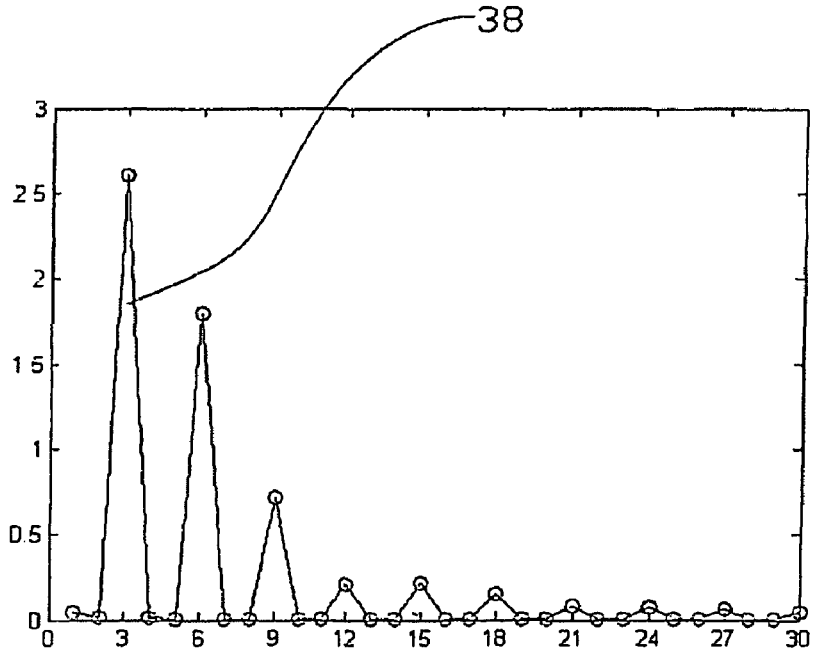
FIG. 5 shows the pressure spectrum derived from the simulated pressure profile as a percentage of the average pressure value.

In FIG. 5 the curve 38 shows the corresponding spectrum of normalized pressure amplitudes ($|P_k|/\overline{p}$) derived from the simulated noise profile shown in FIG. 3. The magnitude at the higher harmonic frequencies falls more rapidly than the corresponding flow rate spectrum, which illustrates the low-pass filter effect in the volume between the pump 1 and the throttle 18.

In the following algorithm for filtering of pump noise a model based method has been used as the starting point. That is, a considerable portion of the pump noise has been modeled theoretically based on knowledge of the pump 1 characteristics and the geometry of the pipe connection 20. The remaining noise, which is the discrepancy between the measured and theoretical noise, is dealt with in an adaptive empirical model. The better the theoretical model, the less comprehensive the empirical model needs to be. At least this is the case as long as the pump operates normally and without leaks.

The main advantages of this method is that the noise filter reacts quickly to changes in the operating conditions, such as pump speed and discharge pressure, and that the parameters of the empirical part of the model can be used in a pump diagnosis because they represent a deviation from the normal expected pump noise.

The algorithm comprises two main parts, each with a number of steps described below.

I) Filtration by Use of the Pump Noise Model:

Steps a) to f) below must be carried out for each new measurement of pressure and angular position of the pump 1, and if there are several pumps, for each pump j, and for each harmonic frequency k from 1 up to a maximum integer such that $k_j \geqq 2\pi f_{max}/\overline{\omega}_j$. In practice, the measuring frequency must be at least 2.5 times higher than $f_{max}$, which is the highest frequency of the telemetry signal.

a) Calculate the theoretical flow component $\hat{Q}_{jk}$ based on the measured crankshaft angle $\theta_j$, mean pump speed $\overline{\omega}_j$, mean (common) discharge pressure $\overline{p}$ and knowledge of the pump 1 characteristics and performance.

b) Calculate the empirical part of the model based on smoothed parameters $\overline{C}_{jk}$ and on the speed and pressure dependent factors $F_{jk}$:

$$\tilde{Q}_{jk}=F_{jk}\overline{C}_{jk}.$$

c) Calculate the sum of theoretical and empirical noise components:

$$Q_{jk}=\hat{Q}_{jk}+\tilde{Q}_{jk}.$$

d) Apply the calculated pressure transfer function $H_{jk}$ to estimate the corresponding complex pressure components:

$P_{jk}=H_{jk}Q_{jk}$.

e) Calculate the partial noise pressure from each pump j:

$$p_j = \sum_{k=1}^{k_j} \mathrm{Re}\{P_{jk} e^{i(k\theta_j)}\}.$$

f) Subtract all individual noise pressures for each of the rotating pumps from the unprocessed noise signal, p, from the pressure gauge 26 to find the resulting pump noise-filtered telemetry signal:

$$p_F = p - \sum_j p_j.$$

II) Update the Pump Noise Model:

Steps g) to h) below must be carried out at the same frequency as the above points, while steps i) to o) are carried out for each complete rotation of pump number j.

g) Calculate the incomplete filtered pressure signal by cancelling the noise pressure correction from pump j.

$$p_{F-j} = p_F + p_j = p - \sum_{m(\neq j)} p_m$$

h) Update complex Fourier integrals from the dynamic part of the partially filtered pressure signals:

$$P_{jk} = \frac{1}{\pi}\int_0^{\theta_j} (p_{F-j} - \overline{p}) e^{i(k\theta_j)} d\theta_j$$

i) Calculate complex normalized flow components by dividing the various pressure components by the known transfer function:

$$Q_{jk} = \frac{P_{jk}}{H_{jk}}$$

j) Calculate the expected flow fluctuation components $\hat{Q}_{jk}$ based on measurements of average speed and discharge pressure, together with knowledge of the actual speed of the pistons, the compressibility of the fluid and valve performance.

k) Subtract these model based components from the measured pressure fluctuation to obtain the residual flow components:

$\tilde{Q}_{jk}=Q_{jk}-\hat{Q}_{jk}$.

l) Divide the residual flow components by appropriate normalization functions $F_{jk}(\overline{p},\overline{\omega}_j)$, selected to make the resulting complex parameters more or less independent of pressure and pumping rate:

$$C_{jk} = \frac{\tilde{Q}_{jk}}{F_{jk}}.$$

m) Use an appropriate low-pass filter (smoothing filter) to reduce the effect of random and non-periodic pressure fluctuations: $\overline{C}_{jk}=LP\{C_{jk}\}$. These parameters represent the adaptive empirical part of the noise model.

n) If two or more pumps 1 rotate in a truly synchronous manner, the partial noise models for these pumps can not be found individually. Because only one set of parameters can be updated, one must either freeze the model parameters for all but one of the synchronously rotating pumps or set several of them to be identical.

o) Zero the Fourier integrals represented by the pressure components $P_{jk}$.

When it comes to the theoretical flow components under point a), these can be calculated either through interpolation of tabulated values calculated in advance for different combinations of pump speed and pressure, or by using a dynamic Fourier analysis based on a real-time simulation of the instantaneous expected flow rate.

It is not essential for the pressure signals to be partially filtered for use in the Fourier analysis, but it is an advantage as is makes the analysis less sensitive to connections between pumps that rotate asynchronously but at approximately the same speed. Eliminating the mean discharge pressure $\overline{p}$, see point "h", is not strictly necessary either, but it helps improve the accuracy of the Fourier integrals when a finite resolution of the angular position of the crankshaft 8 makes it difficult to integrate across exactly one revolution.

By using said method to determine and update individual pump noise models the updating can be performed almost continuously or, to be more precise: For each new pump revolution, also during the transmission of telemetry signals, and while the pump speed varies. The term updating here refers to updating of model parameters. This is not to be confused with the much more frequent calculation and dynamic use of the noise model performed on the basis of changes in the angular position, rotational speed and discharge pressure.

It is crucial that the filter is based on an accurate measurement of the rotational angle of the crankshaft 8 and not on time or an inaccurately estimated crankshaft angle. The reason for this is that the pump speed is never completely constant but varies slightly with variations in loading. Such variations can be harmonic and be caused by e.g. valve defects, or they can be non-harmonic, resulting from e.g. changes in the load on a downhole motor.

The described filter can be considered as an adaptive and extremely sharp band elimination filter that removes the pump noise at the harmonic frequencies of the pump 1, but practically nothing else. Using the rotational angle of the crankshaft 8 as a fundamental variable means that the frequencies of the filter change more or less instantaneously upon changes in the pump speed. If the speed varies periodically, the time based frequency spectrum contains harmonic frequencies with sidebands. An angle based noise filter will remove not only the primary harmonic frequencies but also their sidebands.

The above filtering method also provides a sound basis for a diagnostic tool for quantifying and locating possible leaks. The reason is that the flow fluctuations, and in particular the empirical part that represents the deviation from normal fluctuations, are tied more directly to the condition of the pump than the directly measured pressure fluctuations. Unlike the associated pressure fluctuations, the flow fluctuations are more or less independent of the geometry of the downstream piping.

The following algorithm therefore represents a small addition to the task of filtering pump noise but will be of great value as a diagnostic tool.

The steps A) to C) are performed at the same frequency as the first points of the above described noise filter, while the last few points need only be carried out upon each completed revolution of the pump.

A) Find the theoretical angle based flow function.

$$\hat{q}_j = \sum_{k=1}^{k_j} \mathrm{Re}\{\hat{Q}_{jk} e^{i(k\theta_j)}\}$$

(If the model based flow components $\hat{Q}_{jk}$ are found from a Fourier analysis of the angular position based flow function $\hat{q}_j(\theta_j)$, this may advantageously be used instead of the above Fourier series.)

B) Find the corresponding empirical flow function $$\tilde{q}_j = \sum_{k=1}^{k_j} \mathrm{Re}\{\tilde{Q}_{j,k} e^{i(k\theta_j)}\}.$$

This function represents the deviation from the expected or normal pump operation.

C) The values for angle $\theta_j$ and real normalized flow rates $\hat{q}_j/\overline{q}_j$ and $\tilde{q}_j/\overline{q}_j$ that belong together, are saved for later visualization.

D) Update the graphical display that shows $(1+\hat{q}_j/\overline{q}_j)$ and $(1+\tilde{q}_j/\overline{q}_j)$ as functions of the pump angle $\theta_j$, similar to the graph shown in FIG. 2.

E) Also visualize the amplitude spectra of the normalized flow functions $\hat{Q}_{jk}/\overline{q}_j$ and $\tilde{Q}_{jk}/\overline{q}_j$ as a function of the normalized frequency k, similar to the graph shown in FIG. 4.

The information in the angle and frequency based graphs will to some degree complement each other. In the amplitude spectrum it is beneficial to use a logarithmic scale on the y-axis to more clearly visualize changes in those components that are normally very small. This applies to all components where k is not a multiple of the number of pistons in the pump. Even small leaks will cause a relatively large increase in the magnitude of these components. The amplitude of the lowest component $\tilde{Q}_{jl}/\overline{q}_j$ is particularly suitable for indicating an incipient leak, while the phase $\arg(Q_{jl})$ will be able to provide information regarding the location of the leak.

In the case of major leaks the angle based graph illustrating $1+\tilde{q}_j/\overline{q}_j$ is a better tool for locating leaks or faults.

The invention claimed is:

1. A method of filtering out pressure noise generated by one or more piston pumps, where each pump is connected to a common downstream piping system, and where the discharge pressure is measured by a pressure sensitive gauge, wherein the instantaneous angular position(s) of the pump (s)' crankshaft or actuating cam is/are measured simultaneously with the discharge pressure and used as fundamental variables in an adaptive mathematical noise model, and wherein the adaptive mathematical noise model comprises a theoretical part and an empirical part, the theoretical part representing the expected flow and pressure fluctuations that, for each new pressure measurement, are calculated on the basis of the associated measured angular positions and knowledge of piston speeds, valve characteristics, the compressibility of the fluid and the geometry of the downstream piping system, and the empirical part, which describes discrepancies between measured and expected noise, being calculated as frequently as the theoretical one but being represented by periodically updated model parameters.

2. A method in accordance with claim 1, wherein the adaptive mathematical noise model is periodically updated by a generalised Fourier analysis using the angular position of the pump shafts as fundamental independent variables in the Fourier integrals and transfer functions describing the changes in pressure amplitude and phase as functions of the frequency of certain pump generated flow rate variations.

3. A method in accordance with claim 1, wherein the model parameters in the empirical adaptive mathematical noise model are periodically updated, e.g. upon each completed revolution, also while the pump speed changes and when the telemetry signals are present in the measured common discharge pressure.

4. A method in accordance with claim 1, wherein the two parts of the noise model, represented by complex Fourier series of flow components for each pump, are transformed into functions that show theoretical and empirical flow rates as a function of the angular position of the pumps, and which can therefore be used as diagnostic tools for e.g. quantifying and locating leaks in valves or pistons.

5. A method in accordance with claim 1, wherein the two parts of the noise model, represented by complex Fourier series of flow components for each pump, are transformed into spectra that show theoretical and empirical flow rates as a function of normalized pump frequencies, and which can therefore be used as diagnostic tools for e.g. quantifying and locating leaks in valves or pistons.

* * * * *